US006027067A

United States Patent [19]

Alexander, III et al.

[11] Patent Number: 6,027,067

[45] Date of Patent: Feb. 22, 2000

[54] SPREAD WINDER AND METHOD

[75] Inventors: William J. Alexander, III, Mauldin; Minnerd A. Blegen, Simpsonville; Shala W. Summey, III, Greer, all of S.C.

[73] Assignee: Alexander Machinery, Inc., Simpsonville, S.C.

[21] Appl. No.: 09/126,537

[22] Filed: Jul. 30, 1998

Related U.S. Application Data

[63] Continuation-in-part of application No. 08/617,997, Mar. 18, 1996, abandoned, which is a continuation of application No. 08/292,315, Aug. 19, 1994, abandoned.

[51] Int. Cl.[7] ..... B65H 19/22; B65H 18/14; B65H 18/08

[52] U.S. Cl. ..... 242/533; 242/542.2; 242/534; 242/539; 242/542.3

[58] Field of Search ..... 242/533, 542.2, 242/534.2, 534, 539, 542.3, 563

[56] References Cited

U.S. PATENT DOCUMENTS

| | | | |
|---|---|---|---|
| 2,581,711 | 1/1952 | Roselius | 242/542.2 |
| 3,817,467 | 6/1974 | Dambroth | 242/542.2 |
| 3,869,095 | 3/1975 | Diltz | 242/542 X |
| 4,171,106 | 10/1979 | Crouse | 242/542.2 |
| 4,223,850 | 9/1980 | Alexander, III | 242/542.2 |
| 5,022,597 | 6/1991 | Morizzo | 242/542.2 |

*Primary Examiner*—John Q. Nguyen
*Attorney, Agent, or Firm*—Ralph Bailey, P.A.

[57] ABSTRACT

A spread winder has a stationary support roll (A) in alignment with a moveable support roll (B) which is carried by a moveable frame (D) and which has a drive (E) operated to cause predetermined spreading as the size of the roll increases with suitable core guides (H) controlling the alignment of the core at all times during its horizontal transverse responsive to relative horizontal movement of the rolls during the build. An encoder (I) impresses a home position control on the drive (E) and a home position limit switch (J) provide proper support roll spacing at start up.

9 Claims, 5 Drawing Sheets

SPREAD WINDER AND METHOD

This is a continuation-in-part of application Ser. No. 08/617,997, filed Mar. 18, 1996, abandoned, which is a continuation of application Ser. No. 08/292,315, filed on Aug. 19, 1994, entitled SPREAD WINDER AND METHOD, abandoned.

BACKGROUND OF THE INVENTION

This invention relates to an improved winder for use in winding a web upon a roll carried between a pair of horizontal spreadable support rolls.

Surface winders have been disclosed wherein a pair of parallel horizontal support or bed rolls are separable or spreadable as the cloth roll is being built to offer better support and a lower center of gravity as the size of the web roll increases. A surface winder utilizing spreadable rolls is illustrated in U.S. Pat. No. 4,223,850 which contemplates movement of one or more of the rolls at an angle to the horizontal as the weight of the cloth roll increased during the build. This spreading of the surface winder rolls is accomplished by means of fluid operated cylinders which yield to the increasing weight. It is believed that such devices lack uniformity and consistency in the support of a web roll and in the ability of the support rolls to spread as desired during the build of a cloth roll. Moreover, such a winder lacks accessibility for receiving attention by the operators and is limited as to the doffing apparatus and procedure which may be utilized therewith. Prior art surface winders have been found to lack the precision necessary to properly compensate for increases in weight during the build as are occasioned by the ever increasing size of the web rolls utilized in industry. Such winders are unduly complex from the standpoint of construction and use.

It is important that the distance between the support rolls increases in such a predetermined fashion as to reflect increasing size of the web roll to offer optimum support and accessibility during winding. It is also important that suitable doffing apparatus be available. Another problem is occasioned by the necessity for providing suitable core guides to accommodate the web roll as it moves responsive to spreading of the support rolls during the build. If various sizes of roll cores are to be utilized depending on fabric styles and the like it is important that the support roll spacing on start up be such as to properly position the roll cores at the outset.

SUMMARY OF THE INVENTION

Accordingly, it is an important object of this invention to provide a surface winder having support rolls that are spreadable with precision responsive to increases in size and weight of the web rolls during winding for optimum support.

Another important object of the invention is the provision of a surface winder having spreadable support rolls which have increasing distance between them as the weight and size of the web roll increases during winding which are readily accessible to the operators during the winding operation.

Another important object of the invention is the provision of an improved spread winder wherein doffing mechanism is adapted to be used in the form of a sweep doffer operated in a generally linear path and powered by fluid operated cylinders at respective ends of the doffer roll.

Another important object of the invention is the provision of a surface winder for building rolls of web material in open width wherein the support rolls are driven separately and are controlled in their spreading in response to a programmable logic controller and the like which controls power operated means to assure spreading commensurate with and in proportion to increases in the size and weight of the roll during the winding operation and to provide proper support roll spacing at start up.

It has been found that accessibility to the operators may be enhanced by utilizing a sweep doffer having a generally linear doffing motion, preferably commencing at the stationary side of the spread winder and doffing the roll from a opposite moveable side. A moveable roll is preferably carried in a horizontal plane on a moveable frame depending from a track and the rolls are driven apart in precise fashion responsive to the operation of a programmable logic controller. The rolls are individually driven for spreading by separate motors which are carried respectively on a stationary frame and on a moveable frame, the moveable roll being driven by a motor which is carried by the depending moveable frame which is driven as by a rack and pinion power arrangement and controlled by the programmable logic controller. Core guides are adjustable to receive cores of varying length and extend transversely to offer guidance at any transverse position of the spreadable support rolls during the build.

While the apparatus and method of this invention is described in the context of a cloth roll, the invention has application to any web roll including paper and plastic webs.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a surface winder or batcher for winding rolls of web material in open width on roll cores including a pair of horizontal parallel support rolls A and B aligned in side by side relation in a horizontal plane for supporting a roll core and web roll thereon during the build. A fixed frame C carries one of the rolls A for rotation about a fixed horizontal axis. A movable frame D depends from longitudinal rails for movement thereon in a horizontal plane toward and away from the fixed frame carrying the other roll B for rotation. The movable frame D carries a separate motor 25 positioned beneath the roll B driving it for rotation. Power operated means E carried by the movable frame D moves the frame D carrying the roll B and the drive motor 25 away from the fixed roll A. Control means, such as a programmable logic controller, operates the power operated means moving the movable roll away from the fixed roll progressively as the size of the web roll increases during winding toward a full web roll. A power operated doffer G moves the full web roll from the pair of parallel rolls upon completion of a winding operation. Core guides H are carried in alignment with the roll core during the build of the web roll.

Figure 1:
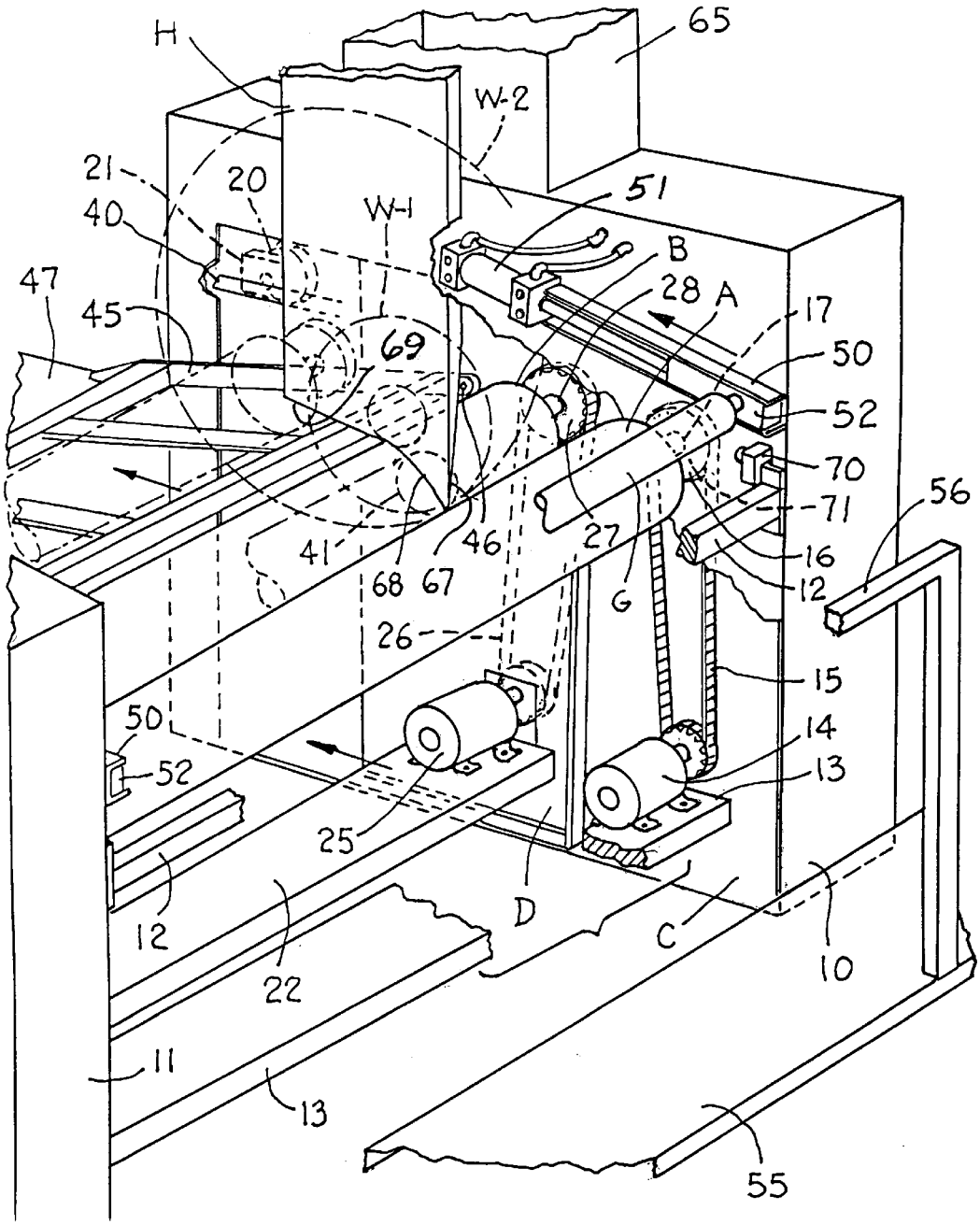
FIG. 1 is a perspective view looking from the left front of a spread winder constructed in accordance with the present invention illustrating the parallel support rolls with one of the rolls being carried by a frame which is moveable progressively outwardly during the build together with a power operated sweep doffer for doffing the roll upon an intermediate support pivoted connected to the moveable frame.
Figure 2:
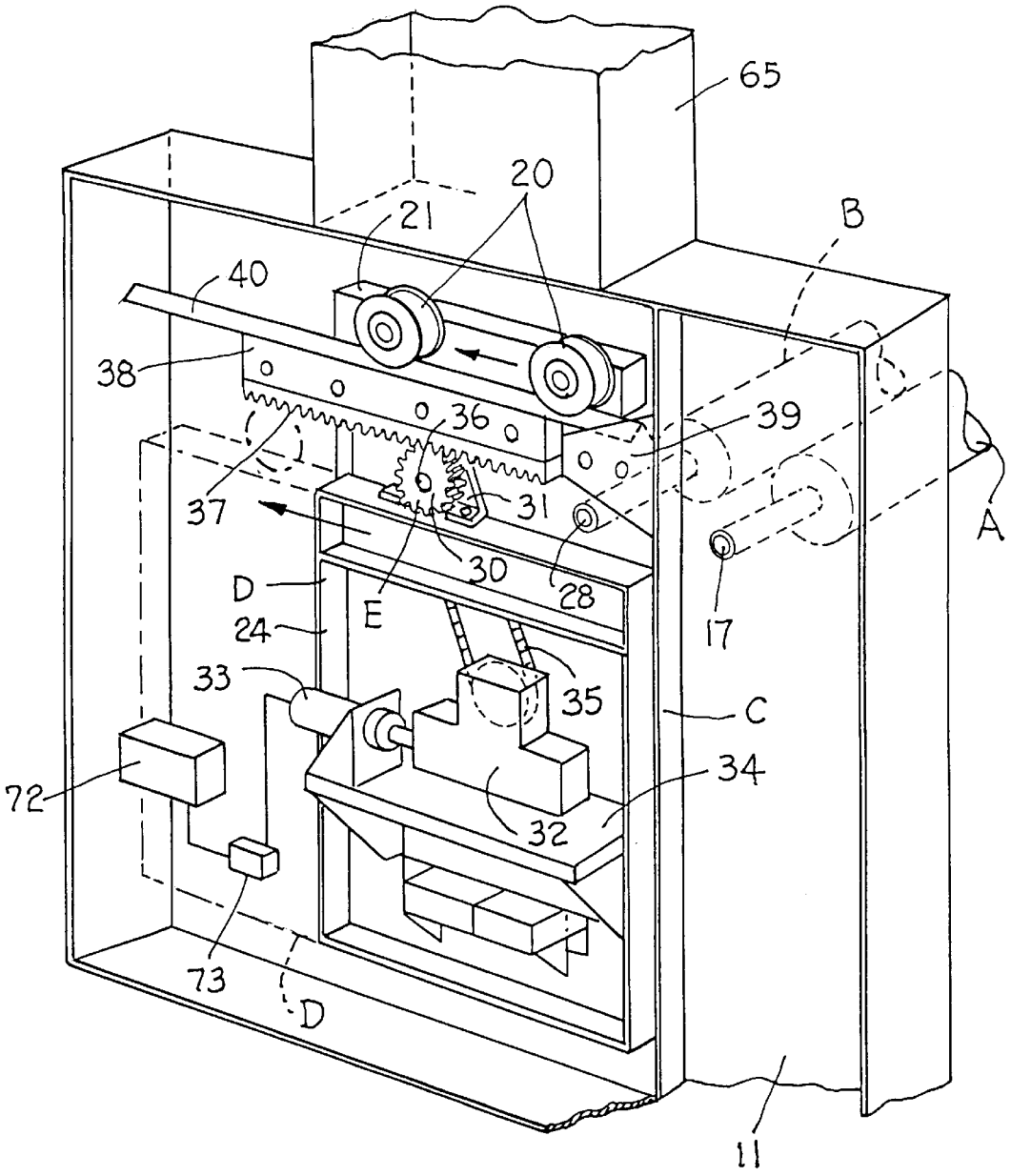
FIG. 2 is a perspective view looking toward the left side and front of the spread winder constructed in accordance with the present invention wherein the drive mechanism for the moveable frame is illustrated as including a motor controlled responsive to a programmed computer for making predetermined adjustments in the spacing between the support rolls as the size of the web roll increases during winding for optimizing the support and the drive provided by support rolls to the web roll.

Referring more particularly to FIGS. 1 and 2, roll A is mounted for rotation upon the fixed side frame members 10 and 11 of which the fixed frame C forms a part. The fixed frame members 10 and 11 are also bridged by a frame member 12 and by a support member 13. The support member 13 carries a motor 14 at one end beneath the fixed roll A for driving same through a suitable drive member such as a chain 15 which in turn drives the sprocket 16 carried by a shaft 17 (FIG. 2). The movable support roll B is carried by the longitudinally movable frame D which is suspended from rollers 20 carried upon mounting member 21 upon the fixed frame C which forms a part of the batcher frame. The frame D moves outwardly and rearwardly in the direction of the arrow (FIG. 2). A motor support member 22 bridges the movable side frame members 23 and 24 which constitute the movable frame D. The motor support member 22 positions the motor 25 for driving the movable roll B through a suitable drive such as the chain 26 which in turn drives a sprocket 27 carried upon a shaft 28.

It will be observed that the power operated member E includes a pinion 30 mounted upon a bracket 31. The sprocket is driven from a suitable gear box 32 which is in turn driven by a fluid motor 33. The motor 33 and gear box 32 are carried upon a suitable support 34. A chain or other suitable drive member 35 is driven from the gear box 32, and this in turn drives the shaft 36 upon which the pinion 30 is mounted. The pinion 30 is in engagement with a rack 37 which is carried upon a support member 38 which has connection through the gusset plate 39 with the fixed frame C through the side frame member 11. A fixed rail 40 is carried upon the rack positioning support 38 for carrying the rollers 20 upon which the movable frame D is supported for longitudinal movement. A similar set of rollers is carried by the side frame member 10 as illustrated in FIG. 1. It will be observed in FIG. 2 that the frame member D may be moved to a dotted line position toward the left. With reference to FIG. 1, the frame D carrying the roll B is moved to dotted line position shown to the left in FIG. 1.

As the movable frame D carries the roll B longitudinally so as to move away from the roll A, the core 41 of the web roll moves from the position between the rollers A and B shown in FIG. 1 progressively to an intermediate position wherein the web roll is indicated at W-1 to a full position shown at W-2 in FIG. 1.

During this movement, a platform bridge 45 is also moved with the movable frame D to which it has pivotal connection as at 46 (FIG. 1). The platform bridge 45 permits the web roll to be doffed to the fixed holding table 47 which supports a free end of the platform bridge 45 during the build. The power operated doffer G is carried in opposed trackways 50 for operation responsive to the action of the fluid operated cylinders 51. A slidable mounting block 52 is carried at each end of the doffer roll G for movement in a horizontal longitudinal sweeping path to doff the web roll when the build is complete.

It will be observed that by utilizing a sweep doffer such as illustrated at G that the support rolls may be positioned closely adjacent the front of the fixed frame member C so that the support rolls and the web roll carried thereby may be readily accessible to the operator. In this connection, FIG. 1 illustrates the use of a worker's platform 55 positioned at the front of the winder under which a cloth web may pass for winding. A guard rail 56 is carried by the worker's platform for the convenience of operators who stand between the frame members 56 and 12 upon the platform 55 at various times during the winding operation.

Figure 3:
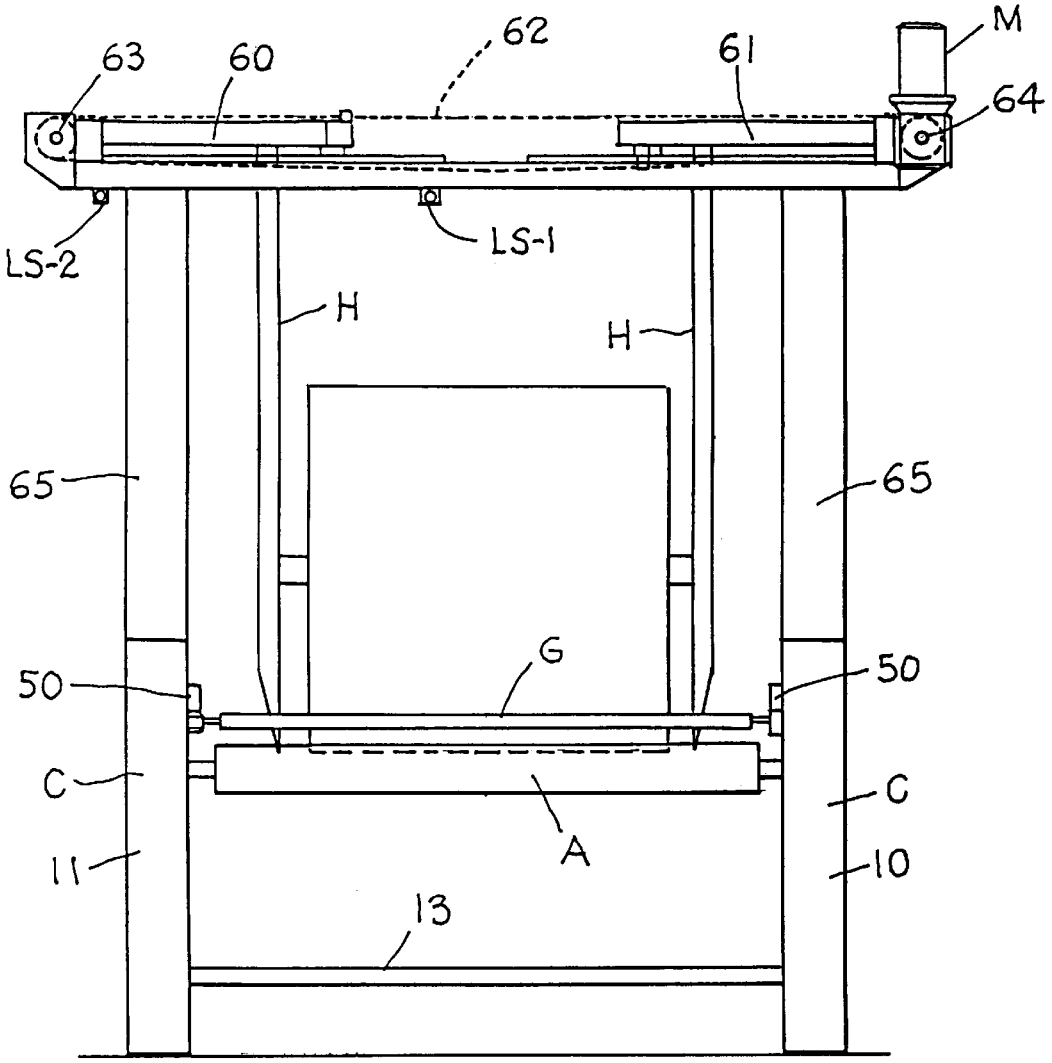
FIG. 3 is a front view illustrating a spread winder constructed in accordance with the invention and particularly illustrating the use of adjustable core guides which are configured so as to remain in alignment with the core as it moves horizontally as the build progresses and as the support rolls move apart relative to each other.

Referring more particularly to FIGS. 1 and 3, it will be observed that the core guides H are carried for transverse movement in and out upon suitable support members 60 and 61. The core guides are coupled together for movement in and out in unison in response to a suitable driven member such as a chain 62 carried between sprockets 63 and 64. The sprocket 64 is driven by a suitable motor M. The frame members 60 and 61 are carried upon standards 65 carried upon the fixed frame member C.

As illustrated in FIG. 1, the core guides H have a leading edge 67 which, together with an upwardly curving lower edge 68, forms a downward projection terminating directly in a central position between the rolls A and B at the beginning of the build. The core guides H are carried for transverse movement in and out on the fixed frame member C between the respective side frame members 10 and 11. The core guides H each have a trailing lower surface 69 extending rearwardly from an upper end of the curved lower portion 68 defining a trailing edge for limiting transverse movement of the core guides at all positions thereof during the build.

Figure 4:
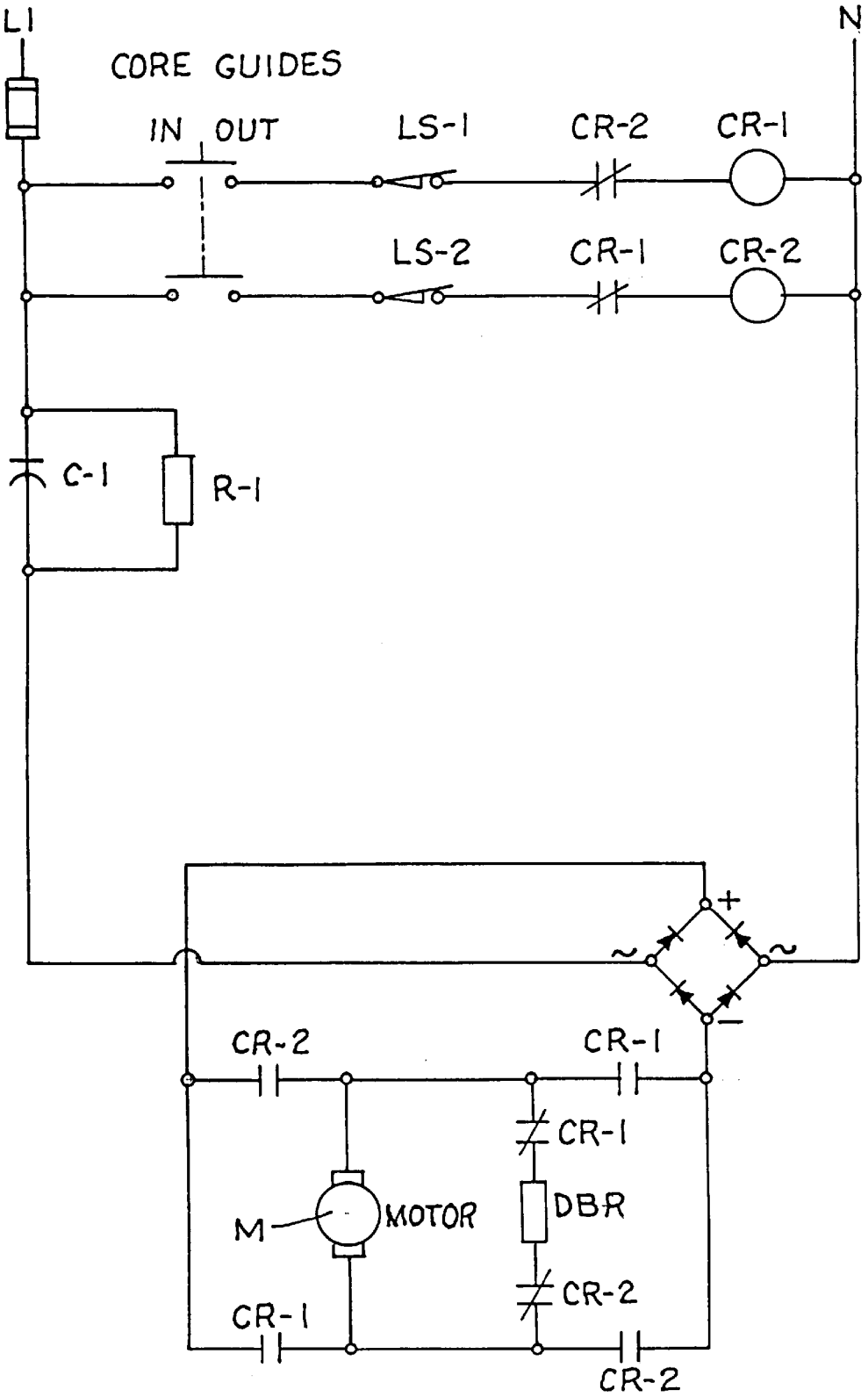
FIG. 4 is a block diagram illustrating the various components and their operation for positioning the core guides.

Referring more particularly to FIG. 4, A.C. power is applied to the lines L1 and N. A three position selector switch or two separate push buttons LS-1 and LS-2 are utilized to activate either CR-1 or CR-2 for moving the core guides in or out. A capacitor C-1 is used to limit current to motor M as well as controlling speed. A full wave bridge rectifier BR-1 converts A.C. to low ripple D.C. to move the core guides (both right and left) in or out together. As an alternative, the core guides may be independently driven in or out separately.

The roll spreading apparatus may be actuated by a photo eye sensor and tape illustrated at 70 and 71 respectively in FIG. 1 or a proximity switch or any other suitable means of counting drive roll rotation. This signal is fed into the programmable logic controller 72 (FIG. 2) which includes a suitable internal counter (not shown). A core size of 3" diameter, for example, may be used. As the roll diameter doubles, the fabric roll length increases four times. This information is built into the programmable logic controller which automatically spreads the drive rolls in response to increases in size of the roll through the action of the hydraulic motor 33 (FIG. 2). A solenoid valve 73 actuates the hydraulic motor.

An algorithm which is a function of drive roll rotation, drive roll size and fabric length may be programmed to control the operation of the fluid motor in order to optimize the spreading of the rolls to best control the building of the web roll at all times during the winding operation. The individual motors may be likewise controlled to provide a desired packing ratio during the build. It is also contemplated that roll diameter may be suitably sensed ultrasonically or by photo eyes for controlling the spreading action.

AUTOMATIC CORE SPACING AT START UP

Automatic core spacing is provided for varying the spacing at start up to accommodate rolls of varying diameters. Heretofore, a fixed roll center on start up of the package changes only when the batcher is winding the fabric roll.

Figure 5:
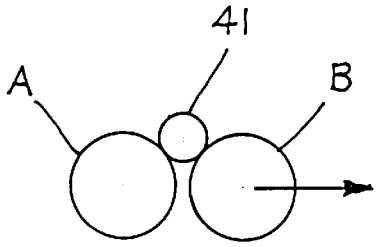
FIG. 5 is a schematic end view looking toward the right hand end of FIG. 1 illustrating adjustment of support roll position on start up preparatory to adjustment to accommodate a roll core of a larger size.
Figure 6:
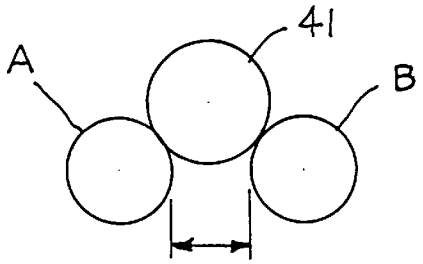
FIG. 6 is a schematic end view similar to FIG. 5 illustrating the movable roll in an adjusted position; and for receiving a larger roll core at start up.

While this feature is not necessary if only one diameter core is utilized, when core diameter varies and fabric styles change, this feature offers an important improvement as the roll size increases. Adjusting this cradling of the core at start up, as schematically illustrated in FIGS. 5 and 6, improves winding of the fabric roll by reducing slippage in some cases or fabric roll distortion in others.

Figure 7:
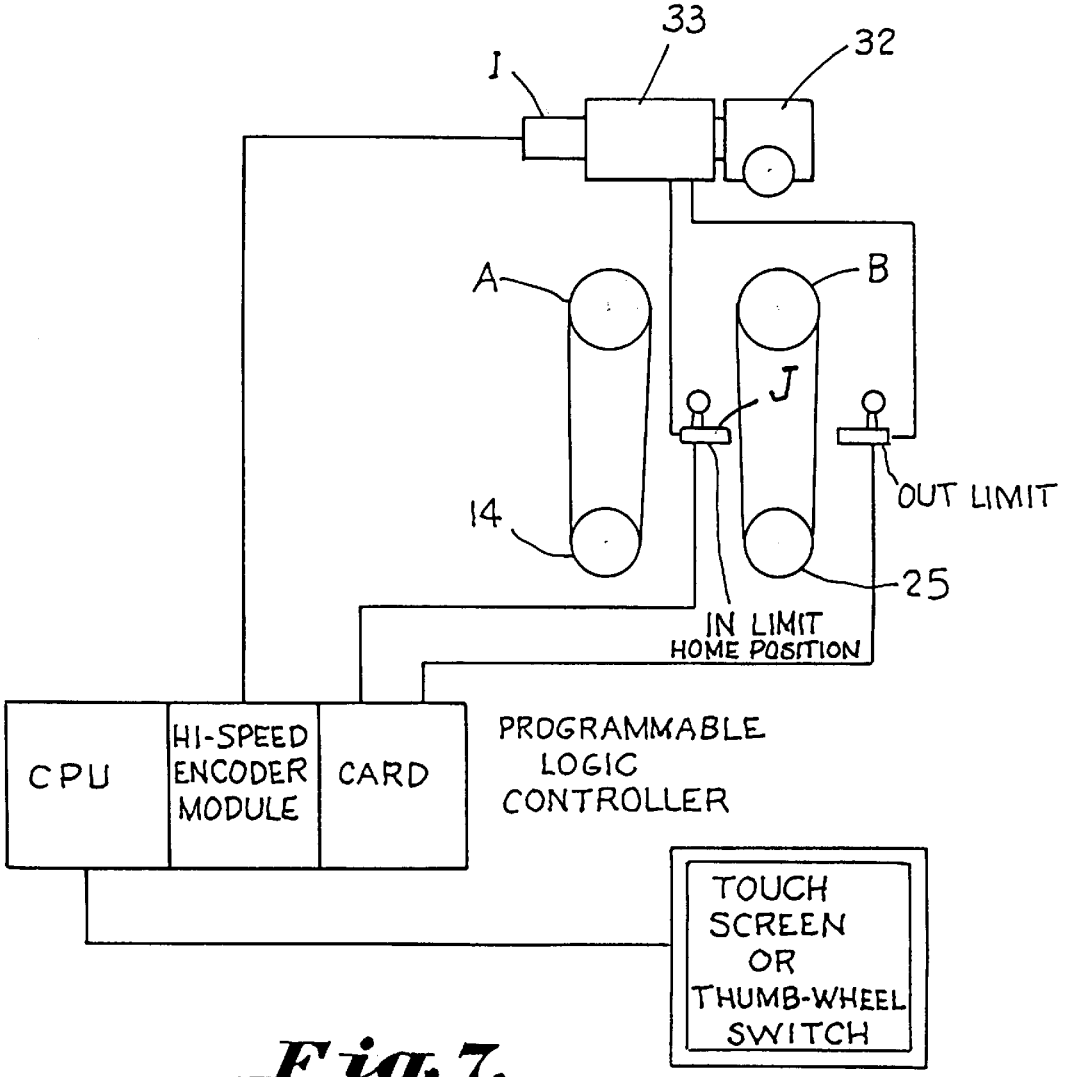
FIG. 7 is a block diagram illustrating the various components for controlling support roll spacing at start up.

Variable roll spacing is accomplished by placing an encoder I with a home marker pulse on the spreading roll motor 33 as shown in FIG. 7. The encoder used in conjunction with a home position limit switch J set in predetermined position establishes the roll spacing as entered by the operator through the PLC. Depending on the number of core sizes the operator is using, a menu on a touch-screen or thumb-wheel switch is set to core diameter. Once set, the support rolls automatically move to this position before the core is placed between the support rolls. The home limit switch may assume any configuration such as a light operated or mechanically operated switch and the like.

It is thus seen that the distance between the support rolls for the web roll increases reflecting the increased size of the web roll for in effect lowering the center thereof to provide optimum support and accessibility. The provision of a sweep doffer at the front of the winder makes the positioning of the support rolls possible for optimizing access to the web roll during the build. The core guides offer end support to the web roll at all times during the spreading of the support rolls during the build. Provision has also been made to improve winding by adjusting roll spacing on start up to accommodate roll cores of various sizes.

While a preferred embodiment of the invention has been described using specific terms, such description is for illustrative purposes only, and it is to be understood that changes and variations may be made without departing from the spirit or scope of the following claims.

What is claimed is:

1. A surface winder for winding rolls of web material on cores comprising:

a pair of horizontal parallel rolls aligned in side by side relation in a horizontal plane for supporting a core and web roll wound thereon;

a fixed frame carrying one of said rolls for rotation about a fixed horizontal axis;

a first motor on said fixed frame positioned below said one roll for driving said one roll for rotation;

spaced aligned longitudinal rails carried in fixed relation, and extending horizontally on said winder;

a movable frame carrying the other of said rolls for rotation about an axis aligned parallel with the axis of said one roll and being suspended in depending relation from and positioned beneath said rails for longitudinal movement in a horizontal plane toward and away from said fixed frame;

a second motor on said movable frame and positioned below said other roll for driving said other roll for rotation; and power operated spreading means progressively moving said movable frame away from said fixed frame during winding.

2. The structure set forth in claim 1 wherein said power operated spreading means includes a drive motor carried on said roll.

3. The structure set forth in claim 1 including a platform pivotally mounted on one end on said movable frame for receiving a full web roll during doffing.

4. The structure set forth in claim 1 including control means for controlling said power operated spreading means including a programmable logic controller; and said motor on said movable frame for moving said movable frame in response to said programmable logic controller.

5. A surface winder for winding rolls of web material on roll cores comprising:

a pair of horizontal parallel support rolls aligned in side by side relation in a horizontal plane for supporting a core and web roll wound thereon;

a first frame carrying one of said rolls for rotation;

a second frame, carried for longitudinal movement toward and away from said first frame, carrying the other of said rolls for rotation;

power operated spreading means moving said second frame a way from said first frame progressively during winding;

a power operated doffer moving a full web roll from said pair of parallel support rolls upon completion of winding;

a platform for receiving doffed web rolls from said second frame;

said platform being attached to said second frame and positioned longitudinally forwardly thereof for longitudinal movement therewith in response to said power operated spreading means; and a worker's platform extending along said first frame so that said support rolls, doffer and said web roll carried thereby may be readily accessible to an operator.

6. A surface winder for winding rolls of web material on roll cores comprising:

a pair of horizontal parallel support rolls aligned in side by side relation in a horizontal plane for supporting a core and web roll wound thereon;

a first frame carrying one of said rolls for rotation;

a second frame, carried for longitudinal movement toward and away from said first frame, carrying the other of said rolls for rotation;

power operated spreading means moving said second frame away from said first frame progressively during winding;

a programmable logic controller for actuating said power operated spreading means during winding;

means for placing an encoder with a home marker pulse on said power operated spreading means; and a home position limit switch used in conjunction with the encoder for positioning the second frame carrying the other of said rolls in predetermined longitudinally spaced positions to accommodate various sizes of roll cores.

7. The method of winding a web upon a roll core utilizing a pair of spaced longitudinal substantially horizontal driven support rolls comprising the steps of:

providing spaced longitudinal rails for supporting at least one of said rolls;

a first fixed frame carrying one roll for rotation about a fixed horizontal axis positioning a second movanle frame carrying the other of said rolls for rotation about an axis aligned parallel with the axis of said one roll and being suspended in depending relation from and positioned beneath said rails and being carried thereby for longitudinal movement on the rails;

moving the depending frame and spreading the roll carried thereon from the other roll during winding of a roll on said roll core; and providing a motor on the depending frame beneath the support roll carried thereby for driving the respective support roll.

8. The method set forth in claim 7 including the steps of:

providing power operated spreading means moving said second frame away from said first frame progressively during winding; and indexing said power operated spreading means to position said depending frame and the roll carried thereby to predetermined home positions on start up to accommodate a plurality of roll core sizes.

9. The method set forth in claim 7 including the steps of:

providing core guides for positioning roll cores upon the support rolls during winding; and coupling said core guides for transverse movement in and out together for positioning the roll cores during winding.

* * * * *

UNITED STATES PATENT AND TRADEMARK OFFICE

CERTIFICATE OF CORRECTION

PATENT NO. : 6,027,067
DATED : February 22, 2000
INVENTOR(S) : William J. Alexander, III, Minnerd A. Blegen, and Shala W. Summey, III It is certified that error appears in the above-identified patent and that said Letters Patent is hereby corrected as shown below:

Claim 1,
Line 6, "parallel with" should read -- parallel to --.

Claim 5,
Line 39, after "frame" should read -- away --.

Claim 7,
Line 12, after "rolls" should read -- for longitudinal movement --.
Line 13, "a first fixed frame" should read -- a first frame --.
Line 14, "fixed horizontal axis" should read -- horizontal axis; --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*